US009199495B2

(12) United States Patent
Kitsuki

(10) Patent No.: US 9,199,495 B2
(45) Date of Patent: Dec. 1, 2015

(54) RECORDING MEDIUM FEEDING DEVICE AND RECORDING APPARATUS

(71) Applicant: SEIKO EPSON CORPORATION, Tokyo (JP)

(72) Inventor: Hiromichi Kitsuki, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/444,574

(22) Filed: Jul. 28, 2014

(65) Prior Publication Data

US 2015/0035923 A1 Feb. 5, 2015

(30) Foreign Application Priority Data

Jul. 31, 2013 (JP) ..... 2013-158648

(51) Int. Cl.

| | |
|---|---|
| ***B41J 2/01*** | (2006.01) |
| ***B41J 13/02*** | (2006.01) |
| ***B65H 1/26*** | (2006.01) |
| ***B65H 3/06*** | (2006.01) |

(52) U.S. Cl.

CPC ..... *B41J 13/025* (2013.01); *B65H 1/26* (2013.01); *B65H 3/0661* (2013.01); *B65H 3/0684* (2013.01); *B65H 2404/62* (2013.01); *B65H 2404/652* (2013.01); *B65H 2405/324* (2013.01)

(58) Field of Classification Search

CPC ..... B41J 11/0015; B41J 11/007; B41J 11/24; B41J 11/42; B41J 13/02; B41J 13/03; B41J 13/08; B41J 13/10; B41J 13/103; B41J 13/12; B65H 3/06–3/0692; B65H 5/06–5/068

USPC ..... 347/101, 104

See application file for complete search history.

(56) References Cited

U.S. PATENT DOCUMENTS

| | | | | |
|---|---|---|---|---|
| 2005/0179192 | A1* | 8/2005 | Miura et al. | 271/118 |
| 2009/0026692 | A1* | 1/2009 | Iwami et al. | 271/118 |

FOREIGN PATENT DOCUMENTS

| | | |
|---|---|---|
| JP | 2001-106362 | 4/2001 |
| JP | 2002-104678 | 4/2002 |

* cited by examiner

*Primary Examiner* — Jannelle M Lebron
*Assistant Examiner* — Jeremy Bishop
(74) *Attorney, Agent, or Firm* — Workman Nydegger

(57) ABSTRACT

A recording apparatus includes a support unit that supports a recording medium; a feed roller that feeds the medium by rotating in contact with the recording medium supported on the support unit; and a swing member that displaces the feed roller comes in contact with and separates from the recording medium, and is provided to support the feed roller and be able to swing with a swing shaft, in which the swing member includes a regulating portion that is able to attain a first state separated from the support unit in a state in which the feed roller is in contact with the recording medium, and a second state that regulates a number of recording media set on the support unit by relatively approaching the support unit more closely than in the first state in a state in which the feed roller is separated from the recording medium.

12 Claims, 9 Drawing Sheets

RECORDING MEDIUM FEEDING DEVICE AND RECORDING APPARATUS

BACKGROUND

1. Technical Field

The present invention relates to a recording apparatus represented by a facsimile, a printer, or the like.

2. Related Art

In the related art, a recording medium in a recording apparatus, such as an ink jet printer, is mounted on a mounting surface and transported from the mounting surface to a recording portion that performs a recording process provided on the downstream side of a feed path by a paper feed roller, recording is executed by the recording portion, and the medium is discharged from the recording apparatus by a discharge unit.

Such recording apparatuses include a paper feed roller provided at a position facing the mounting surface on which the recording medium is mounted, and a movable tray on which a mounting surface able to displace the recording medium in a direction approaching or a direction separating from the paper feed roller is provided (JP-A-2002-104678). Regulation of the number of set recording media mounted on the mounting surface is performed by edge guides provided on both side portions of the mounting surface (JP-A-2001-106362).

The recording apparatus includes a claw member that swings according to the rotation of the paper feed roller. The claw member is configured to attain a feed posture in which the claw member swings to the downstream side in the transport direction when the movable tray approaches the paper feed roller, and the feed roller feeds the recording medium to the downstream side in the transport direction, and the recording medium is able to be fed along the transport path by releasing the regulated state of the recording medium, and a standby posture in which the claw member returns from the feed posture by the paper feed roller being reversely rotated when the recording medium is transported, the recording medium is pushed back to the mounting surface of the movable tray, and the recording medium is held on the mounting surface in a state in which the movable tray is separated from the paper feed roller at times other than when the paper feed roller feeds the medium.

A sheet regulating portion is provided on the claw member. The sheet regulating portion is configured to be able to enter a facing state with the mounting surface of the movable tray, in the standby posture, and regulate the number of recording media able to be set on the movable tray.

However, in the recording apparatuses, the operation of the claw member is necessarily not only interlocked with the rotation of the paper feed roller, but is also interlocked with the operation of the movable tray that displaces in a direction approaching and separating from the paper feed roller, an interlocking mechanism for the claw member and the movable tray, a cam mechanism by which the movable tray is displaced, a locking mechanism that locks the movable tray or the like become necessary, and there is concern of the feeding mechanism of the recording medium becoming complicated or the recording apparatus increasing in size.

The recording apparatus disclosed in JP-A-2001-106362 is configured such that an upper limit regulating member that regulates the number of set recording media mounted on the mounting surface is provided at the edge guide.

However, in a case in which the number of sheets set in the recording apparatus is large, a load occurs due to contact between the sheet surface and the upper limit regulating member, thereby becoming a factor in an increase in rubbing defects or in the paper feed load, and worsening of the paper feed precision. When the upper limit regulating member is provided at the edge guide, there is concern of the recording apparatus increasing in size.

SUMMARY

An advantage of some aspects of the invention is to provide a recording apparatus able to regulate, with a simple configuration, the number of recording media supported by a support unit and able to achieve size reduction of the apparatus, without the use of an edge guide that regulates the number of sheets set.

According to a first aspect of the invention, there is provided a recording apparatus including a support unit that supports a recording medium; a feed roller that feeds the medium along a transport path by rotating in contact with the recording medium supported on the support unit; and a swing member that displaces the feed roller in a direction in which the feed roller comes in contact with and separates from the recording medium by swinging, and is provided to support the feed roller and be able to swing with a swing shaft as a center, in which the swing member includes a regulating portion that is able to attain a first state separated from the support unit in a state in which the feed roller is in contact with the recording medium, and a second state that regulates a number of recording media set on the support unit by relatively approaching the support unit more closely than in the first state in a state in which the feed roller is separated from the recording medium.

According to the aspect, since a regulating portion able to attain a first state separated from the support unit and a second state that regulates the number of recording media set on the support unit by relatively approaching the support unit more closely than in the first state is provided on the swing member that displaces the feed roller in a direction in which the feed roller comes in contact with and separates from the recording medium by swinging and that is provided to support the feed roller and be able to swing with the swing shaft as a center, it is possible to regulate, with a simple configuration, the number of recording media supported by the support unit, and possible to achieve a size reduction in the recording apparatus.

According to a second aspect of the invention, it is preferable that a regulating position where the regulation of the recording medium in the regulating portion is performed be positioned further to the upstream side of the transport path than a position between the swing shaft and the support unit on the transport path.

According to the aspect, by the regulating position being positioned further to the upstream side of the transport path than the position between the swing shaft and the support unit on the transport path, when the recording medium is inserted to the support unit, it is possible for the user to easily recognize that a stipulated number of sheets is set even if the recording medium is not inserted deep into the interior of the apparatus main body.

According to a third aspect of the invention, it is preferable to further include an apparatus main body in which the swing member is provided; and a feed port which is positioned further to the upstream side of the transport path than the regulating position where the regulating portion regulates the recording medium and in which the recording medium inserted toward the apparatus main body interior is received, in which the regulating position is visible via the feed port.

According to the aspect, since the regulating position is visible via the feed port, it is possible to easily visually confirm that a stipulated number of the recording media is set in the support unit. Accordingly, it is possible to prevent bending of or damage to the recording medium by excessively setting recording media in the stipulated numbers or more in the support unit.

According to a fourth aspect of the invention, it is preferable that the regulating portion include a roller that abuts on the recording medium in the regulated state.

According to the aspect, by providing the roller on the regulating portion, it is possible to prevent damage or soiling on the recording surface of the recording medium by rotating the roller that abuts on the recording medium when the recording medium is set on the support unit.

According to a fifth aspect of the invention, it is preferable that a plurality of regulating portions be provided along an axial direction of the swing shaft.

According to the aspect, since a plurality of regulating portions is provided along the axial direction of the swing shaft, it is possible to form a plurality of regulating positions in the width direction of the recording medium. Accordingly, when the recording medium is set in the support unit, it is possible to prevent the recording medium from being set inclined with respect to the axial direction, and since it is possible to reduce the concern of feeding as is in the inclined state, it is possible to prevent paper jams.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, embodiments of the invention are described with reference to the drawings. Moreover, the same configurations in each embodiment have the same references applied thereto, description thereof will be made only in the first embodiment, and description of the configurations will not be repeated in subsequent embodiments.

Figure 1:
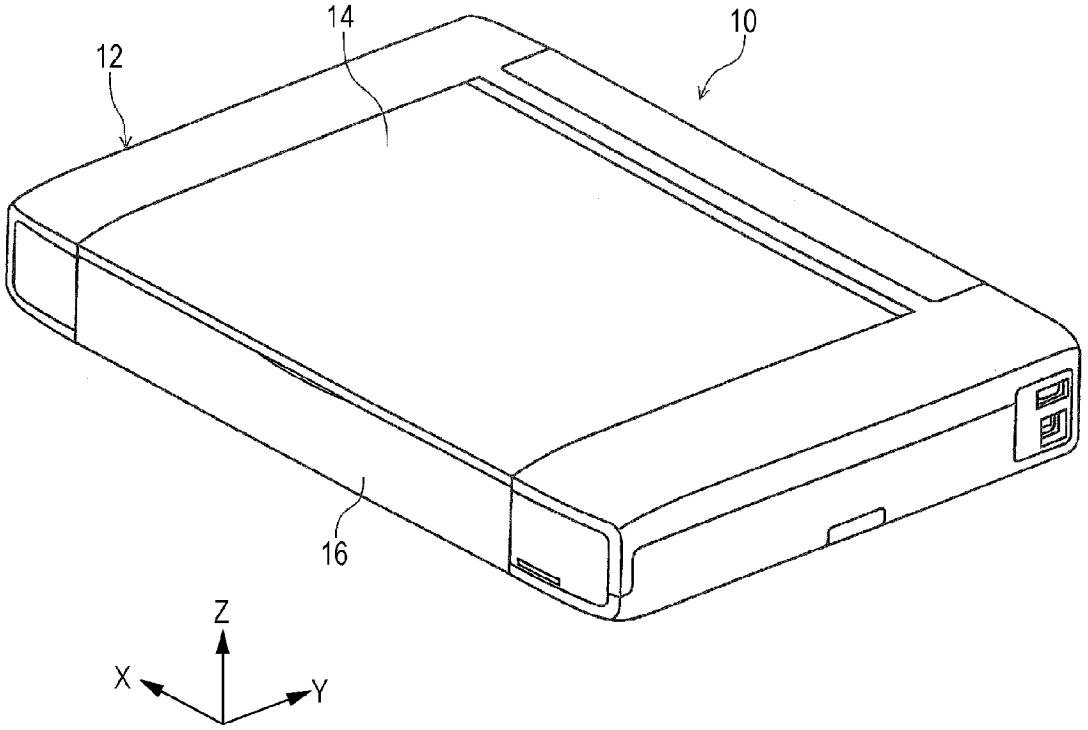
FIG. 1 is a perspective view of a printer according to an aspect of the invention.
Figure 2:
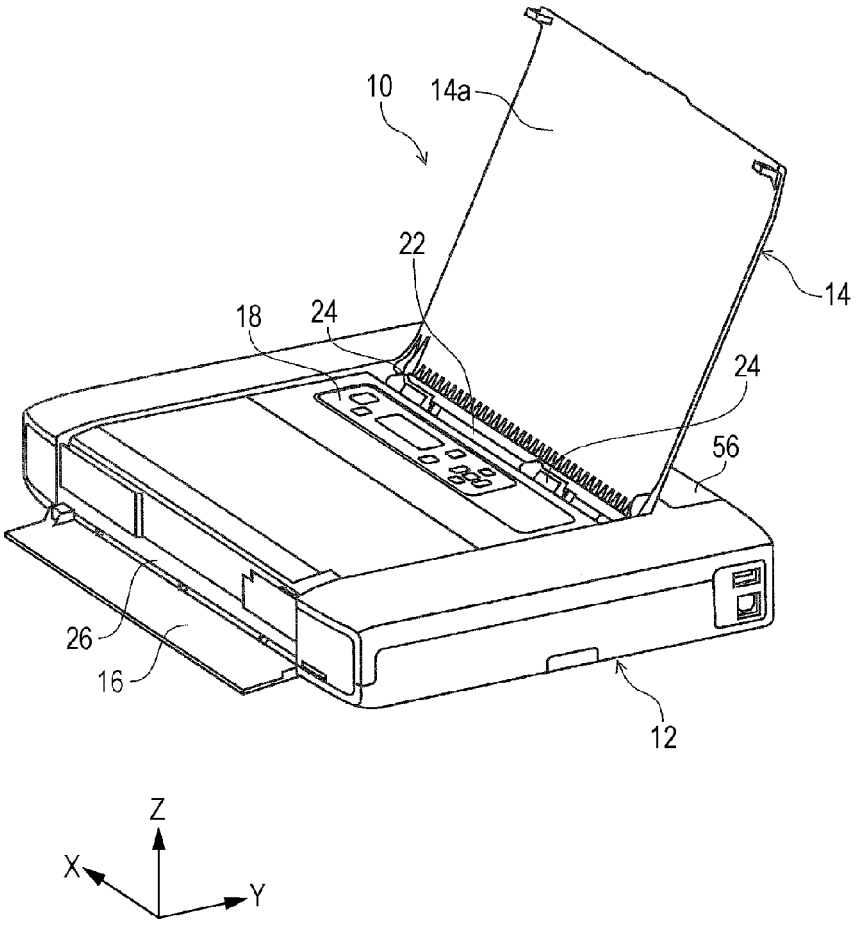
FIG. 2 is a perspective view showing a state in which the paper feed cover in the printer according to an aspect of the invention is opened.
Figure 3:
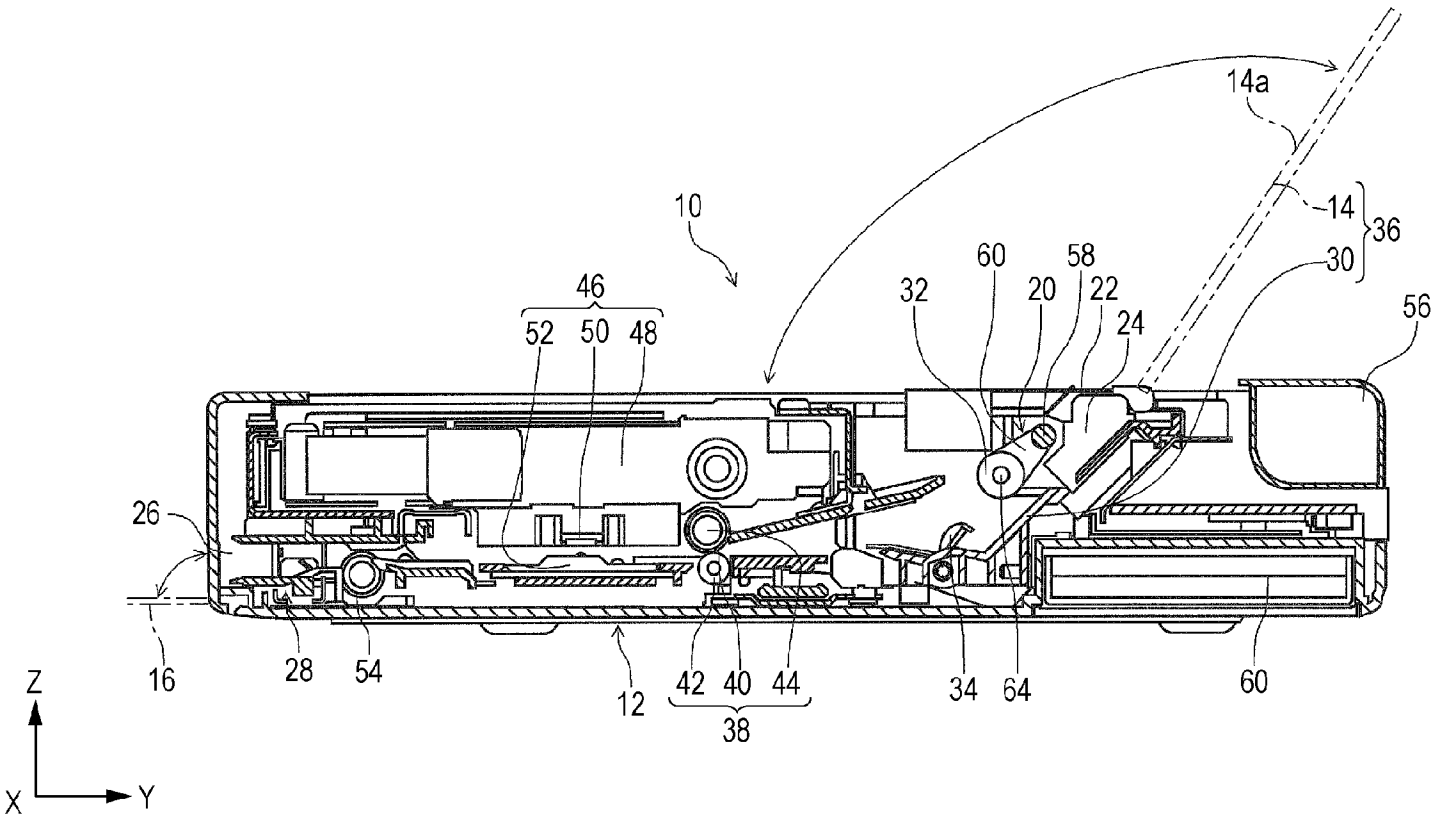
FIG. 3 is a side cross-sectional view showing a paper transport path of the printer according to an aspect of the invention.
Figure 4:
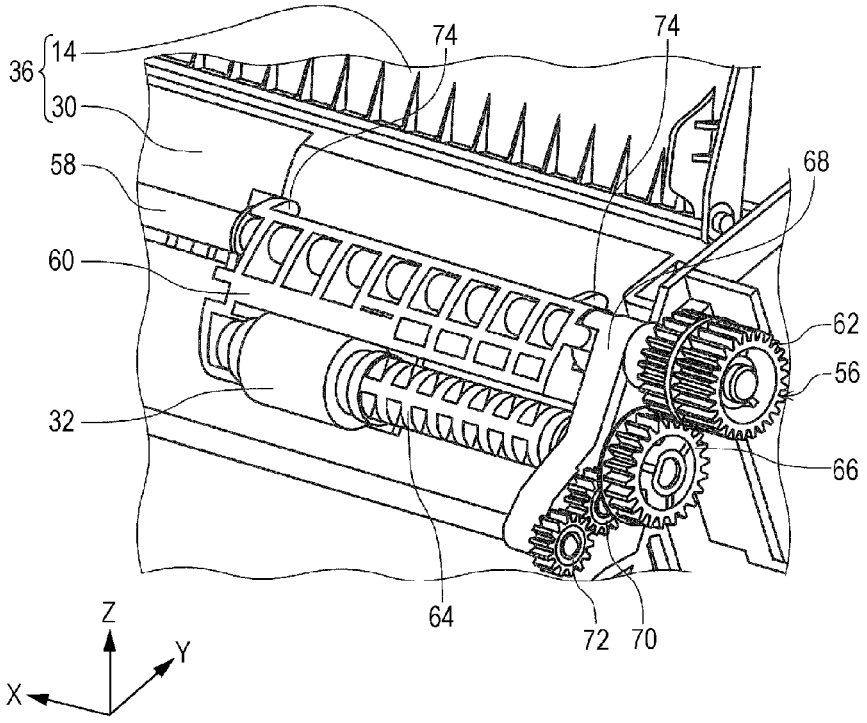
FIG. 4 is a perspective view of a medium supply portion according to a first embodiment.
Figure 5:
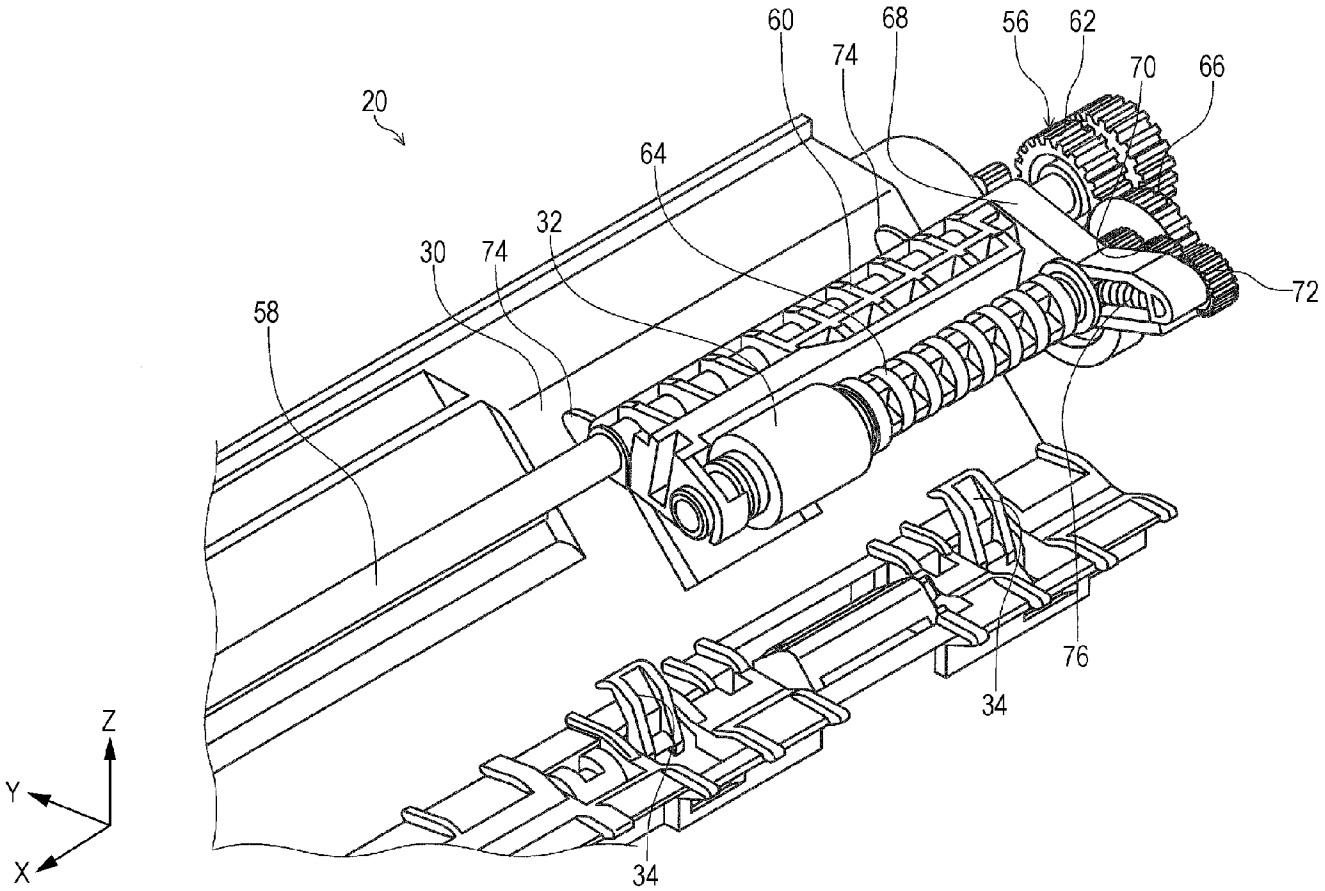
FIG. 5 is a perspective view of a medium supply portion according to the first embodiment.

FIG. 1 is a perspective view of a printer according to an aspect of the invention, FIG. 2 is a perspective view showing a state in which the paper feed cover in the printer according to an aspect of the invention is opened, FIG. 3 is a side cross-sectional view showing a paper transport path of the printer according to an aspect of the invention, FIG. 4 is a perspective view of a medium supply portion according to a first embodiment, and FIG. 5 is a perspective view of a supply portion according to the first embodiment.

Figure 6A:
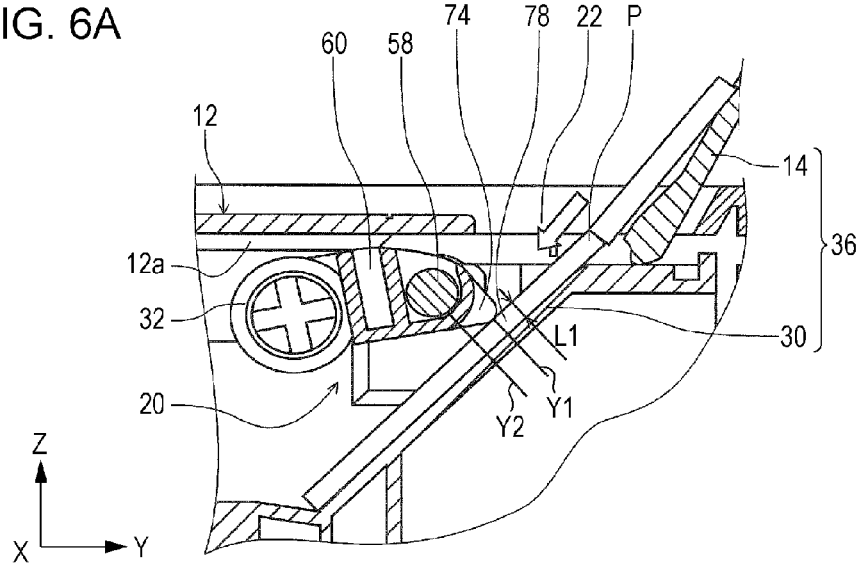
FIG. 6A is a side cross-sectional view showing a second state in the regulating portion according to the first embodiment.
Figure 6B:
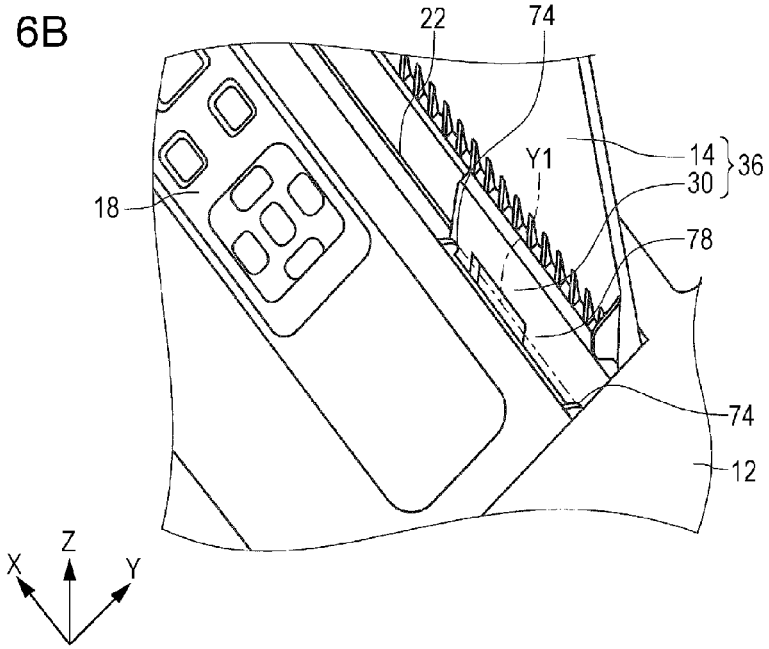
FIG. 6B is a perspective view showing the regulating portion viewed from a feed port.
Figure 7:
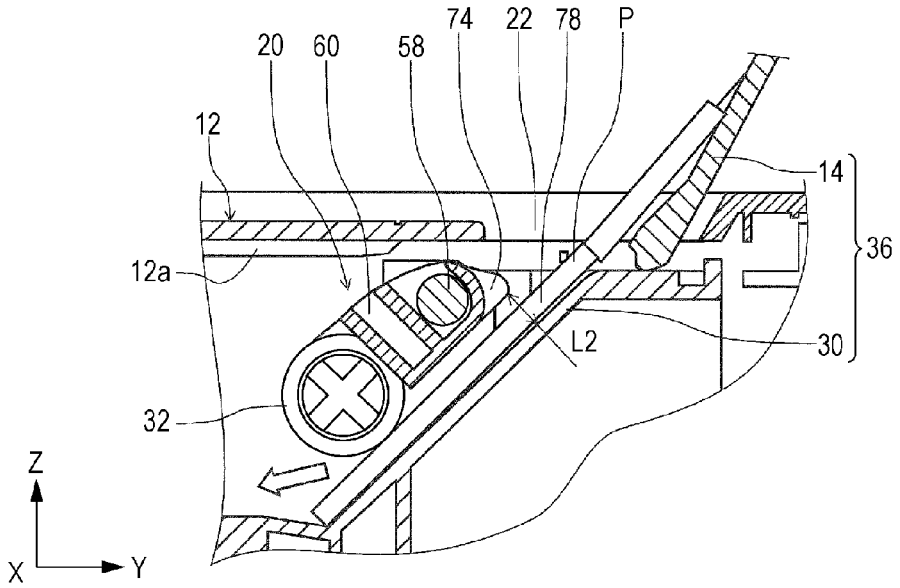
FIG. 7 is a side cross-sectional view showing a first state in the regulating portion according to the first embodiment.
Figure 8:
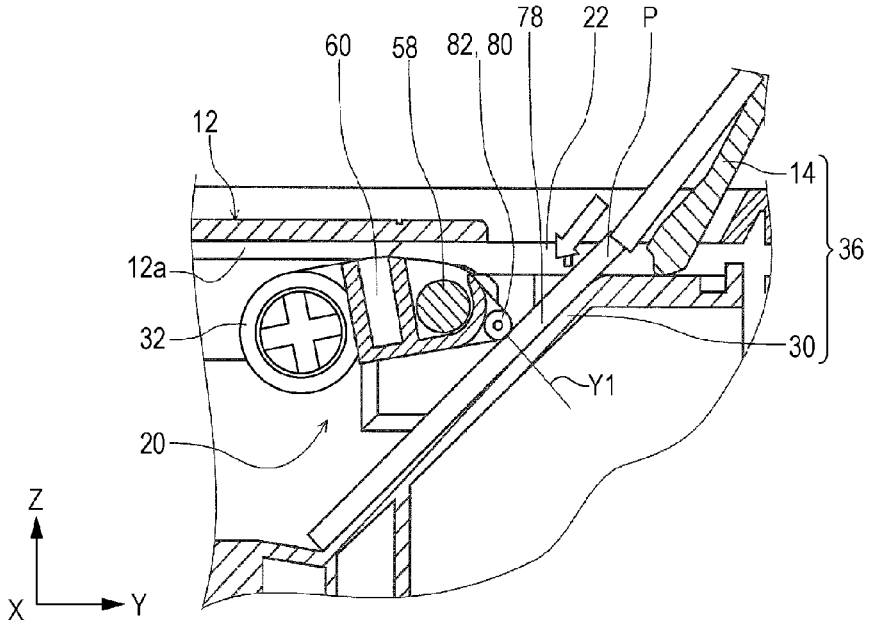
FIG. 8 is a side cross-sectional view showing a second state of the regulating portion according to a second embodiment.
Figure 9:
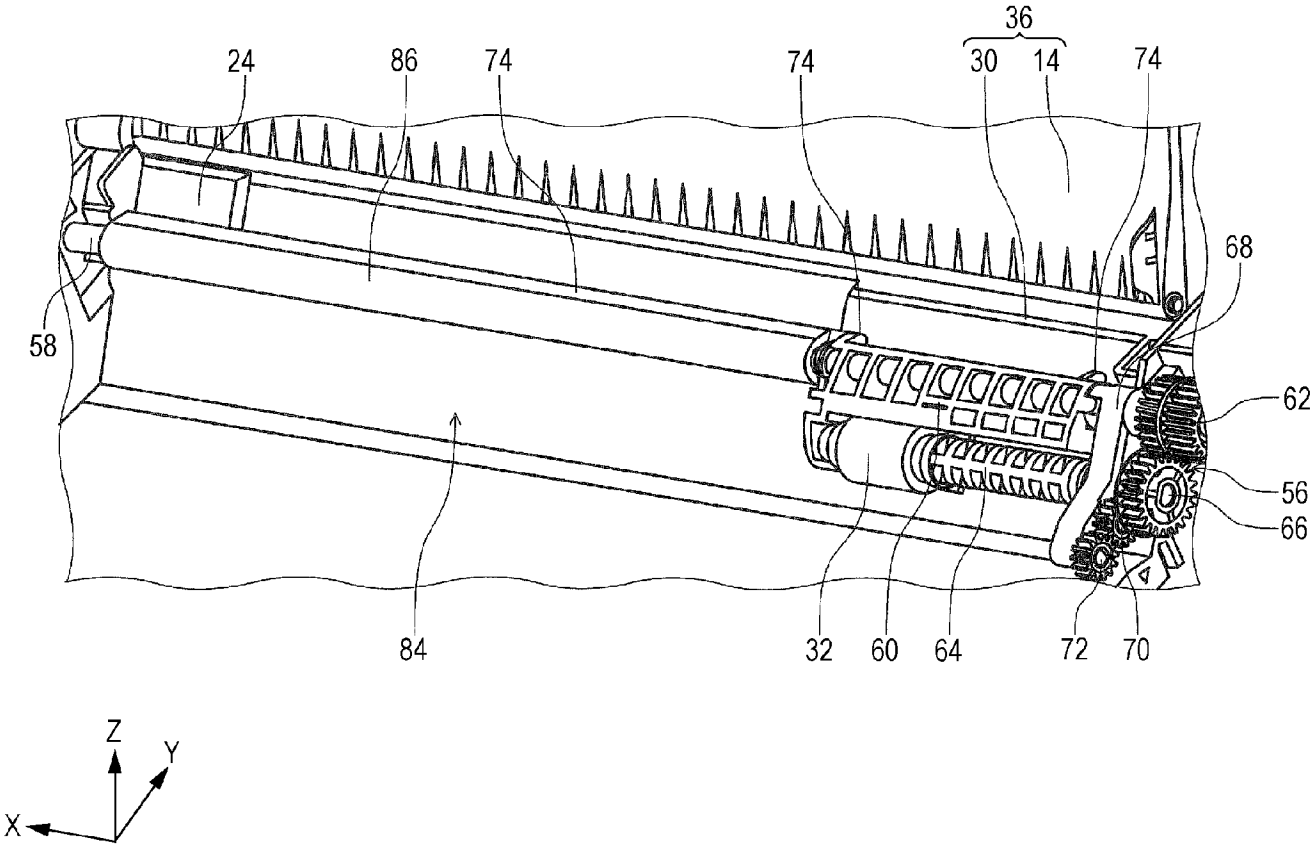
FIG. 9 is a perspective view of a medium supply portion according to a third embodiment.
Figure 10:
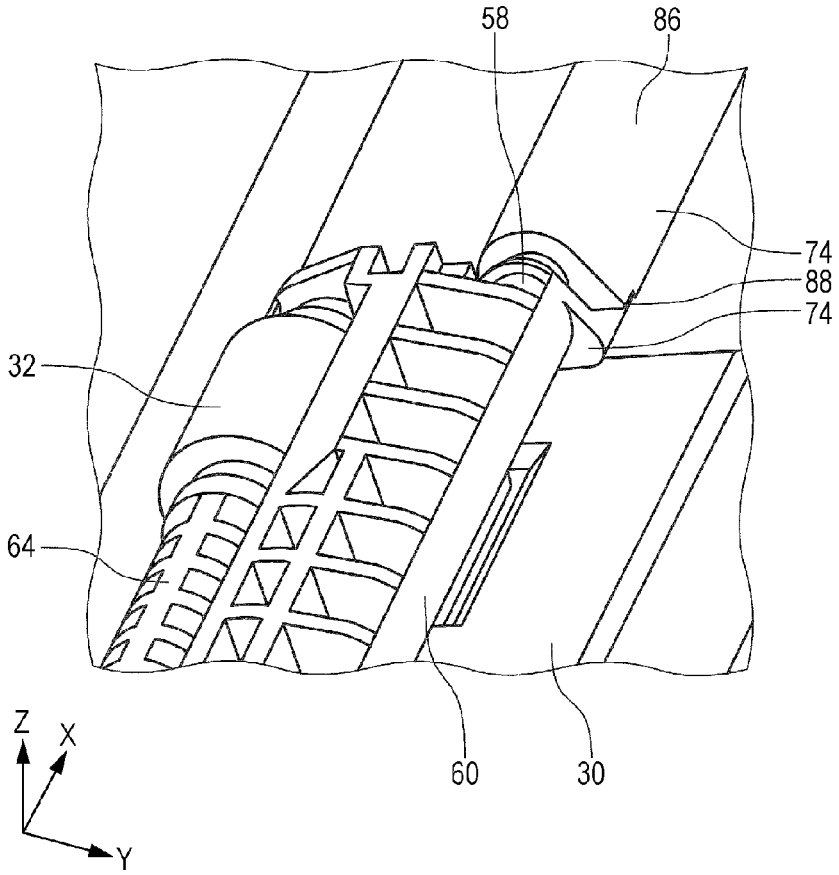
FIG. 10 is an enlarged view of the peripheral edge of the regulating portion in the medium supply portion according to the third embodiment.

FIG. 6A is a side cross-sectional view showing a second state in the regulating portion according to the first embodiment, FIG. 6B is a perspective view showing the regulating portion viewed from a feed port, FIG. 7 is a side cross-sectional view showing a first state in the regulating portion according to the first embodiment, FIG. 8 is a side cross-sectional view showing a second state in the regulating portion according to a second embodiment, FIG. 9 is a perspective view of a supply portion according to a third embodiment, and FIG. 10 is an enlarged view of the peripheral edge of the regulating portion in the supply portion according to the third embodiment.

In the X-Y-Z coordinate system shown in each diagram, the X direction indicates the scanning direction of the recording head, the Y direction the depth direction of the recording apparatus, and the Z direction the direction changing the distance (gap) between the recording head and the medium P, that is, the height direction of the apparatus. In each diagram, the −Y direction is set to the front surface side of the apparatus, and the +Y direction is set as the rear surface side of the apparatus.

Outline of Recording Apparatus

The overall configuration of the printer 10 will be described with reference to FIGS. 1 and 2. The printer 10 includes an apparatus main body 12, a paper feed cover 14, a discharge port cover 16, and an operation portion 18 (refer to FIG. 2).

The paper feed cover 14 is provided on the upper surface of the printer 10. The paper feed cover 14 is attached to the upper surface of the apparatus main body 12 to be rotatable. The paper feed cover 14 is able to attain an opened state (refer to FIG. 2) and a closed state (refer to FIG. 1) with respect to the apparatus main body 12. In a case in which the paper feed cover 14 is in the closed state with respect to the apparatus main body 12, the cover configures the upper surface of the apparatus main body 12 and the upper surface of the printer 10.

In a case in which the paper feed cover 14 is in the open state (refer to FIG. 2) with respect to the apparatus main body 12, the paper feed cover enters a state of being inclined to the rear surface side (+Y direction side) of the printer 10. In this state, the rear surface of the paper feed cover 14 functions as a medium support surface 14*a* that supports the medium P (refer to FIG. 6A) as a "recording medium".

In a case in which the paper feed cover 14 as shown in FIG. 2 is in the opened state with respect to the apparatus main body 12, the medium feed port 22 as a "feed port" of the medium supply portion 20, described later, of the apparatus main body 12 enters an opened state with respect to above the printer 10. Therefore, the medium supply portion 20 is able to feed the medium P mounted on the medium support surface 14*a* to the feed path, described later. A pair of medium guides 24 configured to be able to move to approach and separate in the width direction (X axis direction) of the printer 10 is provided at the medium feed port 22. The pair of medium guides 24 is bundled at both ends in the width direction of the medium P, and regulates the position of the medium P in the width direction of the apparatus.

The operation portion 18 (refer to FIG. 2) is configured to include a power button, print setting button, or the like, for operating the printer 10. In a case in which the paper feed cover 14 is in the opened state with respect to the apparatus main body 12, the user is able to access the operation portion 18, and able to operate the printer 10.

A discharge port cover 16 is provided on the front surface of the apparatus main body 12. The discharge port cover 16 is attached to the apparatus front surface to be able to rotate, to enable the discharge port 26 provided in the front surface of the apparatus main body 12 to open and close. The discharge port cover 16 is able to attain an opened state (refer to FIG. 2) and a closed state (refer to FIG. 1) with respect to the apparatus main body 12.

The discharge port cover 16, in a case in which the discharge port cover is in the opened state with respect to the apparatus main body 12, allows the medium P on which recording is executed to be discharged to the front of the printer 10 from a discharge portion 28, described later, of the apparatus main body 12 via the discharge port 26.

Medium Feed Path

Next, the constituent elements on the medium feed path in the printer 10 will be described with reference to FIG. 3. In FIG. 3, the right side of the paper surface (apparatus rear surface side) is the upstream of the feed path, and the left side of the paper surface (apparatus front surface side) is the downstream of the feed path.

A medium supply portion 20 that feeds the medium P to the downstream side of the feed path from the medium support surface 14*a* of the paper feed cover 14 in a state of being opened with respect to the apparatus main body 12 is provided on the upstream side of the feed path. The medium supply portion 20 includes a medium feed port 22, a pair of medium guides 24 provided on the medium feed port, a medium support portion 30 that supports at least a portion of the medium P inserted from the medium feed port 22, a pick-up roller 32 as a "feed roller" provided at a position facing the medium support portion 30, and a return lever 34. The paper feed cover 14 and the medium support portion 30 configure the support unit 36 that supports the medium P. The support unit 36 supports the medium P with an inclined posture.

The medium support portion 30 forms an inclined form that descends toward the −Y direction side in FIG. 3. The pick-up roller 32 is configured to be able to swing in a direction that approaches and separates from the medium P mounted on the medium support portion 30. When the pick-up roller 32 is displaced in a direction that approaches the medium support portion 30, the pick-up roller comes into contact with the uppermost medium P mounted on the medium support portion 30, and feeds the uppermost medium P to the downstream side of the feed path. In this case, the next and subsequent media P are returned to the medium support portion 30 by the return lever 34, and the next and subsequent media P are prevented from being unintentionally fed to the downstream side of the feed path.

A transport portion 38 is provided to the downstream side of the medium supply portion 20. The transport portion 38 includes a transport driving roller 40 and a transport driven roller 42. The transport driving roller 40 is integrally attached to a transport roller shaft 44, and is caused to rotate along with the transport roller shaft 44 by a driving source, not shown. The transport portion 38 nips the medium P fed from the medium supply portion 20 between the transport driving roller 40 and the transport driven roller 42, and transports the medium to the downstream side in the transport direction. A recording portion 46 is provided on the downstream side of the transport portion 38.

The recording portion 46 includes a carriage 48, a recording head 50 provided on the bottom portion of the carriage, and a lower guide member, that is, a platen 52, as a support portion that supports the medium P and faces the recording head. The recording head 50 faces the medium P supported by the platen 52. The carriage 48 is driven to reciprocate in the main scanning direction (the front to back direction of the paper surface, that is, the X axis direction, in FIG. 3) by a driving motor, not shown, controlled by a controller (not shown) provided on the interior of the apparatus main body 12. The platen 52 regulates the distance (gap) between the recording surface of the medium P and the head surface of the recording head 50 by supporting the medium P from beneath.

A discharge portion 28 is provided on the downstream side of the recording portion 46 in the transport direction. The discharge portion 28 includes a discharge roller 54. The medium P on which recording is executed by the recording portion 46 is discharged by the discharge roller 54 toward the front of the apparatus from the discharge port 26 formed in the apparatus front surface.

First Embodiment

In a case in which the pick-up roller 32 is configured to maintain a state in which the pick-up roller 32 abuts on the medium P when the medium P is not transported, there is concern of additives of the roller that configures the pick-up roller 32 seeping on to the medium P. The medium P is transported to the recording portion 46 with the additives staining the medium P, when recording is executed, ink does not attach to the parts stained by the additives in the medium P, and there is concern of unevenness in the image quality arising.

In the configuration, when the medium P is set on the medium support portion 30 via the medium feed port 22, it is necessary that the user displace the pick-up roller 32 to a separation position from the abutting position with the medium P, and the workability decreases.

When the medium P is set on the medium support portion 30 via the medium feed port 22 with the pick-up roller 32 positioned unchanged at the abutment position with the medium P, the uppermost medium P and a plurality of the next and subsequent media P mounted on the medium support portion 30 are positioned further forward than the nip position between the pick-up roller 32 and the medium support portion 30. As a result, when the medium P is transported in this state, the medium P is not transported even if the pick-up roller 32 is rotated, and there is concern of nonfeeding of the medium occurring.

Accordingly, the basic concept of the present invention is that when the medium P in the medium supply portion 20 is transported, the pick-up roller 32 abuts on the medium P, the medium P is transported to the downstream side in the transport direction due to the rotation of the pick-up roller 32, and when the medium P is not transported, the pick-up roller 32 is put in a state of being separated from the medium P.

Pick-Up Roller Contact and Separation Mechanism

The medium supply portion 20 of the first embodiment according to an aspect of the invention will be described in detail with reference to FIGS. 4 and 5. The medium supply portion 20 includes a pick-up roller contact and separation mechanism 56 by which the pick-up roller 32 is displaced in a direction that approaches and separates from the medium P. The pick-up roller contact and separation mechanism 56 is configured to include a swing shaft 58, a swing member 60, a first driving gear 62, a pick-up roller drive shaft 64 (referred to below as "drive shaft 64"), a second driving gear 66, a support member 68, a transmission gear 70, and an engaging gear 72.

The swing shaft 58 extends in the X axis direction, that is, in the width direction of the medium P, in FIG. 4, and is provided at a position facing the medium support portion 30. The swing shaft 58 is caused to rotate by a driving motor, not shown. The first driving gear 62 is provided at one end of the swing shaft 58 (end portion of the −X axis side in FIG. 4). The drive shaft 64 which extends in the X direction in FIG. 4 is arranged in parallel to the swing shaft 58, leaving a gap with the swing shaft 58.

The second driving gear 66 that meshes with the first driving gear 62 is provided at one end of the drive shaft 64 (end portion of the −X axis side in FIG. 4), and the pick-up roller 32 is provided at the other end of the drive shaft 64. The pick-up roller 32 rotates along with the drive shaft 64 when the drive shaft 64 is caused to rotate by the driving motor (not shown) via the swing shaft 58, the first driving gear 62, and the second driving gear 66.

The swing member 60 that swings with the swing shaft 58 as a center is provided on the swing shaft 58. The end portion of the swing member 60 on the +X axis side in FIG. 4 supports the other end of the drive shaft 64 (end portion on the +X axis side in FIG. 4) so that the drive shaft 64 is able to rotate. When the swing member 60 is centered on the swing shaft 58, the regulating portion 74 is provided on the opposite side to the side on which the drive shaft 64 is provided, that is, the side opposite the medium support portion 30 of the swing member 60 in the state in which the pick-up roller 32 is separated from the medium support portion 30. The regulating portion 74 will be described in detail later.

The support member 68 is provided on the end portion on the −X direction side in FIG. 4 of the swing member 60. The drive shaft 64 is inserted in the support member 68. The transmission gear 70 that meshes with the second driving gear 66 and the engaging gear 72 that meshes with the transmission gear are attached to the support member 68 to be able to rotate. A spring member 76 that exhibits a biasing force between the drive shaft 64 and the support member 68 is further provided on the support member 68.

The spring member 76 causes rotational and frictional resistance to occur on the second driving gear 66 (and the engaging gear 72) by applying a biasing force with a direction that intersects the axial direction of the swing shaft 58 and the drive shaft 64 between the drive shaft 64 and the support member 68. When the second driving gear 66 is caused to rotate by the first driving gear 62 due to the rotational and frictional resistance, the second driving gear 66 rotates around the first driving gear 62.

In so doing, the drive shaft 64 (and the swing member 60 and the support member 68) swings around the swing shaft 58. As a result, the pick-up roller 32 supported on the swing member 60 and the support member 68 and the transmission gear 70 and the engaging gear 72 attached to the support member 68 swing around the swing shaft 58 along with the swing member 60 and the support member 68. The swing member 60 causes the pick-up roller 32 to be displaced in a direction that approaches and separates from the medium support portion 30, that is, the medium P supported by the medium support portion 30 (refer to FIGS. 6A and 7).

In the pick-up roller contact and separation mechanism 56, when the pick-up roller 32 is displaced in a direction that separates from the medium P (refer to FIG. 6A), the engaging gear 72 engages with a rack portion, not shown, provided on the apparatus main body 12 to be able to release, and the swing member 60, the support member 68, and the pick-up roller 32 are held in a state separated from the medium P.

The first driving gear 62, the second driving gear 66, the transmission gear 70, the engaging gear 72 and the support member 68 in the pick-up roller contact and separation mechanism 56 is provided outside the region of the medium P in the X axis direction.

Regulating Portion of Swing Member

Next, the regulating portion 74 provided on the swing member 60 will be described with reference to FIGS. 6A to 7. The regulating portion 74, is able to attain a regulation released state as a "first state" separated from the medium P as shown in FIG. 7, and a regulated state as a "second state" that regulates the number of media P set on the medium support portion 30 by approaching the medium support portion 30 more closely than in the regulation released state as shown in FIG. 6A due to swinging of the swing member 60.

In FIG. 6A, the swing member 60 swings in a clockwise direction in FIG. 6A with the swing shaft 58 as a center. The swing member 60 abuts on the upper frame 12*a* of the apparatus main body 12, and swinging is prevented. In this case, the engaging gear 72 and a rack portion, not shown, enter an engaged state, and the swing member 60 maintains a state of abutting on the upper frame 12*a*.

In this state, the regulating portion 74 of the swing member 60 enters a state of approaching toward the medium support portion 30, that is, a regulated state. The regulating portion 74 is held at a position separated by a distance L1 with respect to the medium support portion 30. A frontage 78 of the amount of the distance L1 is formed between the regulating portion 74 and the medium support portion 30.

Accordingly, it is possible to set the number of media P corresponding to the length L1 of the frontage 78 in the state in which the media P are stacked on the medium support portion 30. That is, because the regulating portion 74 restricts the frontage 78 with the medium support portion 30 in the regulated state to the length L1, the number of more of the media P corresponding to the length L1 is not inserted on the medium support portion 30 from the frontage 78, and it becomes difficult to set the medium P on the medium support portion 30.

The regulating portion 74 contacts the uppermost medium P of the media P superimposed on the medium support portion 30 at the position Y1 (refer to FIG. 6A) on the transport path in the state in which the media P are set on the medium support portion 30. The position Y1 is positioned further to the upstream side of the transport path than the position Y2 (refer to FIG. 6A) between the swing shaft 58 and the medium support portion 30 on the transport path.

The regulating position Y1 (refer to FIG. 6A) with respect to the medium P of the regulating portion 74, as shown in FIG. 6B, is set to a position visible via the medium feed port 22, when the medium feed port 22 is viewed from above the apparatus main body 12, that is, the +Z axis direction side in FIG. 6B.

Accordingly, by the regulating position Y1 (refer to FIG. 6A) being positioned further to the upstream side of the transport path than the position Y2 (refer to FIG. 6A) between the swing shaft 58 and the medium support portion 30 on the transport path, when the medium P is inserted to the medium support portion 30, it is possible for the user to easily recognize that a stipulated number of sheets is set even if the medium P is not inserted deep into the interior of the apparatus main body 12.

Since the regulating position Y1 (refer to FIG. 6A) is visible via the medium feed port 22, it is possible to easily visually confirm that a stipulated number of the recording media P is set on the medium support portion 30. Accordingly, it is possible to prevent bending of or damage to the recording medium P by excessively setting recording media P in the stipulated numbers or more on the medium support portion 30.

Next, as shown in FIG. 7, when the swing member 60 swings in the counter clockwise direction in FIG. 7, the engaging state between the engaging gear 72 and the rack portion, not shown, is released, the pick-up roller 32 contacts the medium P superimposed on the medium support portion 30, thereby entering a state of being able to feed. In this case, the regulating portion 74 is displaced in a direction that separates from the medium P, that is, from the medium support portion 30, and enters the regulation released state.

The distance between the regulating portion 74 and the medium support portion 30 changes from L1 to L2. Here, the distance L2 is set to be greater than the distance L1. Since the pick-up roller 32 displaced in a direction approaching the medium support portion 30 as the media P are sequentially fed to the downstream side of the transport path by the pick-up roller 32, the regulating portion 74 conversely separates form the medium support portion 30, and the distance L2 becomes greater.

Accordingly, since the regulating portion 74 does not abut on the medium P in the regulation released state, feeding of the medium P to the downstream side in the transport direction by the pick-up roller 32 is not obstructed. Since the regulating portion 74 does not contact the medium P during feeding of the medium P, it is possible to reduce or avoid concern of the regulating portion 74 scratching or damaging the surface of the medium P.

By arranging the pick-up roller 32 and the regulating portion 74 on opposite sides of the swing member 60 with the swing shaft 58 interposed, since the regulating portion 74 enters the regulation released state to the medium P when the pick-up roller 32 is in the feed state and the regulating portion 74 enters the regulated state when the pick-up roller 32 is in the nonfeeding state, a mechanism, or the like, that approaches and separates the medium P toward the pick-up roller 32 by the medium support portion 30 being displaced may be not provided, and it is possible for the medium supply portion 20 to have a simple configuration.

The swing member 60 that displaces the pick-up roller 32 in a direction in which the pick-up roller 32 comes in contact with and separates from the recording medium P by swinging and is provided to support the pick-up roller 32 and be able to swing with the swing shaft 58 as a center includes a regulating portion 74 able to attain a first state separated from the medium support portion 30 and a second state that regulates the number of recording media P by relatively approaching the medium support portion 30 more closely than in the first state. Accordingly, the printer 10 is able to regulate, with a simple configuration, the number of recording media supported by a support unit and it is possible to achieve size reductions in the printer 10.

Modification Example of First Embodiment

In the present embodiment, although the regulating portion 74 is configured by only being formed on both ends in the X direction of the swing member 60 in FIG. 4 or the like, instead of this configuration, a plurality of regulating portions 74 may be provided at appropriate intervals in the X axis direction, or the regulating portion 74 may be formed along the entire length of the swing member 60 in the X axis direction. Although the pick-up roller 32 is a one-sided press, that is, one-sided feed, center feeding that feeds paper from the center may also be used.

Second Embodiment

The regulating portion 80 according to the second embodiment of the invention is depicted with reference to FIG. 8. The regulating portion 80 differs from the first embodiment on the feature of providing a roller 82 on the front end of the regulating portion.

The regulating portion 80 includes a freely rotatable roller 82 at a site that abuts with medium P in the regulated state. In so doing, by the roller 82 that abuts on the medium P rotating when the medium P is set on the medium support portion 30 in the regulated state of the regulating portion 80, it is possible to prevent damage, soiling or the like of the recording surface of the medium P.

Third Embodiment

The medium supply portion 84 according to the third embodiment of the invention is depicted with reference to FIGS. 9 and 10. The medium supply portion 84 differs from the first embodiment on the feature of providing an auxiliary member 86 in the axial direction of the swing shaft 58.

With reference to FIG. 9, the swing member 60 is arranged at the end portion of the −X direction side on the swing shaft 58. The auxiliary member 86 is provided between the end portion on the +X direction side of the swing shaft 58 and the swing member 60. The auxiliary member 86 extends in the X axis direction in a state in which the swing shaft 58 is inserted. The auxiliary member 86 is formed with the regulating portion 74 along the full length thereof in the X axis direction.

With reference to FIG. 10, a groove 88 is formed on the end portion on the −X axis direction side of the auxiliary member 86. A portion of the swing member 60 engages with the groove 88. In so doing, when the swing member 60 swings with the swing shaft 58 as a center, the auxiliary member 86 is able to swing interlocked with the swinging of the swing member 60.

Accordingly, since a plurality of regulating portions 74 is provided along the axial direction (X axis direction in FIG. 9) of the swing shaft 58, a plurality of regulating positions Y1 (refer to FIG. 6A) can be formed in the width direction of the medium P. Accordingly, when the medium P is set on the medium support portion 30, it is possible to prevent being set with an incline with respect to the axial direction (X axis direction in FIG. 9), and since it is possible to reduce the concern of being feed as is in the inclined state, it is possible to prevent paper jams.

Modification Example of Third Embodiment

In the present embodiment, although the regulating portion 74 is formed along the entire length of the auxiliary member 86 in the X axis direction, instead of this configuration, a plurality of regulating portions 74 may be provided with gaps therebetween in the X axis direction. The plurality may be provided according to the size of the medium.

In summary, a printer 10 in the present embodiment includes a support unit 36 that supports a recording medium P; a pick-up roller 32 that feeds the medium P along a transport path by rotating in contact with the medium P supported on the support unit 36; and a swing member 60 that displaces the pick-up roller 32 in a direction in which the pick-up roller 32 comes in contact with and separates from the medium P by swinging, and is provided to support the pick-up roller 32 and be able to swing with a swing shaft 58 as a center.

The swing member 60 includes a regulating portion 74 able to attain a first state separated from the support unit 36 in a state in which the pick-up roller 32 contacts the medium P and a second state that regulates the number of recording media P set on the support unit 36 by relatively approaching the support unit 36 more closely than in the first state in a state in which the pick-up roller 32 is separated from the medium P.

The regulating position Y1 that regulates the medium P of the regulating portion 74 is positioned further to the upstream side of the transport path than the position Y2 between the swing shaft 58 and the support unit 36 on the transport path. The printer 10 includes an apparatus main body 12 in which the swing member 60 is provided, and a medium feed port 22 positioned further to the upstream side than the regulating position Y1 at which the regulating portion 74 regulates the medium P, and in which the medium P inserted toward the interior of the apparatus main body 12 is received on the transport path. The regulating position Y1 is visible via the medium feed port 22.

The regulating portion 74 includes a roller 82 that abuts with the medium P in the regulated state. A plurality of regulating portions 74 is provided along the axial direction of the swing shaft 58.

In the embodiment, although the recording apparatus 10 according to an aspect of the invention is applied to an ink jet printer as one example of a recording apparatus, the recording apparatus is also generally applicable to other liquid ejecting apparatuses.

The liquid ejecting apparatus is not limited to a printer, copy machine, fax machine or the like in which an ink jet type recording head is used and which performs recording on a recording medium by ejecting ink from the recording head, and includes an apparatus ejecting, in place of ink, a liquid corresponding to other uses from a liquid ejecting head corresponding to an ink jet type recording head to an ejection medium corresponding to a recording medium, and the liquid is applied to the ejection medium.

In addition to the recording head, examples of the liquid ejecting head include a color material ejecting head used in the manufacturing of a color filter for a liquid crystal display or the like, an electrode material (conductive paste) ejecting head used in electrode formation of an organic EL display, a field emission display (FED), or the like, a bio-organic ejecting head used in biochip manufacturing, or a sample ejecting head as a precision pipette.

The invention is not limited to the embodiments described above and may be modified in various ways within the aspects disclosed in the invention, and the modifications should be construed as being included in the invention.

The entire disclosure of Japanese Patent Application No. 2013-158648, filed Jul. 31, 2013 is expressly incorporated by reference herein

What is claimed is:

1. A recording apparatus comprising:

a support unit that is openably fixed to the apparatus and that supports a recording medium;

a feed roller that feeds the medium along a transport path by rotating in contact with the recording medium supported on the support unit; and a swing member that displaces the feed roller in a direction in which the feed roller comes in contact with and separates from the recording medium by swinging, and is provided to support the feed roller and be able to swing with a swing shaft as a center, wherein the swing member includes a regulating portion that is able to attain a first state separated from the support unit in a state in which the feed roller is in contact with the recording medium, and a second state that regulates a number and a height of recording medium set on the support unit by relatively approaching the support unit more closely than in the first state in a state in which the feed roller is separated from the recording medium, wherein the feed roller is downstream of the regulation portion and wherein the swing shaft is between the feed roller and the regulating portion.

2. The recording apparatus according to claim 1, wherein a regulating position where regulation of the recording medium by the regulating portion is performed is positioned further to an upstream side of the transport path than a position between the swing shaft and the support unit on the transport path.

3. The recording apparatus according to claim 1, further comprising:

an apparatus main body in which the swing member is provided; and a feed port which is positioned further to an upstream side of the transport path than a regulating position where the regulating portion regulates the recording medium and in which the recording medium inserted toward the apparatus main body interior is received, wherein the regulating position is visible via the feed port.

4. The recording apparatus according to claim 2, further comprising:

an apparatus main body in which the swing member is provided; and a feed port which is positioned further to the upstream side of the transport path than the regulating position where the regulating portion regulates the recording medium and in which the recording medium inserted toward the apparatus main body interior is received, wherein the regulating position is visible via the feed port.

5. The recording apparatus according to claim 1, wherein the regulating portion includes a roller that abuts on the recording medium in the regulated state.

6. The recording apparatus according to claim 2, wherein the regulating portion includes a roller that abuts on the recording medium in the regulated state.

7. The recording apparatus according to claim 3, wherein the regulating portion includes a roller that abuts on the recording medium in the regulated state.

8. The recording apparatus according to claim 1, wherein a plurality of regulating portions is provided along an axial direction of the swing shaft.

9. The recording apparatus according to claim 2, wherein a plurality of regulating portions is provided along an axial direction of the swing shaft.

10. The recording apparatus according to claim 3, wherein a plurality of regulating portions is provided along an axial direction of the swing shaft.

11. The recording apparatus according to claim 4, wherein a plurality of regulating portions is provided along an axial direction of the swing shaft.

12. The recording apparatus according to claim 8, wherein the regulating portion is formed at a position that corresponds to the size of the medium.

* * * * *